US006824410B1

(12) United States Patent
Co et al.

(10) Patent No.: US 6,824,410 B1
(45) Date of Patent: Nov. 30, 2004

(54) ZERO-INSERTION-FORCE HINGED CLAM-SHELL SOCKET FOR TESTING MEMORY MODULES

(75) Inventors: Ramon S. Co, Trabuco Canyon, CA (US); Tat Leung Lai, Torrance, CA (US); David Sun, Irvine, CA (US)

(73) Assignee: Kingston Technology Corp., Fountain Valley, CA (US)

( * ) Notice: Subject to any disclaimer, the term of this patent is extended or adjusted under 35 U.S.C. 154(b) by 0 days.

(21) Appl. No.: 10/709,154

(22) Filed: Apr. 16, 2004

(51) Int. Cl.[7] ..... H01R 13/62
(52) U.S. Cl. ..... 439/260; 439/261; 324/755
(58) Field of Search ..... 439/260, 259, 439/261–262, 265, 122; 324/754, 755

(56) References Cited

U.S. PATENT DOCUMENTS

| | | | | |
|---|---|---|---|---|
| 4,164,704 | A | 8/1979 | Kato et al. | 324/72.5 |
| 4,344,033 | A | 8/1982 | Stowers et al. | 324/754 |
| 4,560,221 | A | 12/1985 | Olsson | 439/373 |
| 4,629,270 | A | 12/1986 | Andrews, Jr. et al. | 439/260 |
| 5,153,504 | A | 10/1992 | Bonnet et al. | 324/754 |
| 5,461,323 | A | 10/1995 | Yanagi et al. | 324/754 |
| 5,795,172 | A | 8/1998 | Shahriari et al. | 439/260 |
| 5,813,876 | A | 9/1998 | Rutigliano | 439/260 |
| 5,973,285 | A | 10/1999 | Dietrich et al. | 209/573 |
| 6,046,421 | A | 4/2000 | Ho | 209/573 |
| 6,071,137 | A | 6/2000 | Rutigliano | 439/197 |
| 6,133,745 | A | 10/2000 | Yoon et al. | 324/755 |
| 6,344,751 | B1 | 2/2002 | Prokopp et al. | 324/754 |
| 6,357,023 | B1 | 3/2002 | Co et al. | 714/42 |
| 6,415,397 | B1 | 7/2002 | Co et al. | 714/42 |
| 6,469,496 | B1 | 10/2002 | Khouw et al. | 324/158.1 |
| 6,572,396 | B1 | 6/2003 | Rathburn | 439/260 |
| 6,696,848 | B2 | 2/2004 | Robinson | 324/755 |

*Primary Examiner*—Michael C. Zarroli
(74) *Attorney, Agent, or Firm*—Stuart Auvineu

(57) ABSTRACT

A test socket for testing memory modules requires little or no insertion force. A base holds a funnel-shaped guide that guides the edge of the memory module into a desired position. Two housing halves are connected to the base by one or more hinges. The housing halves pivot around the hinges to open and close the test socket. Linkages, springs, or solenoids move the housing halves. Metal contact pads on flexible membranes are attached to each housing half and clamp onto contact pads on an inserted memory module when the housing halves are closed. Scooped vise clamps can be used to pinch together the ends of the housing halves to close the test socket. More test sockets can be fitted into a smaller pitch using the scooped vise clamps since the solenoids are along the longer axis of the test socket.

20 Claims, 6 Drawing Sheets

ZERO-INSERTION-FORCE HINGED CLAM-SHELL SOCKET FOR TESTING MEMORY MODULES

BACKGROUND OF INVENTION

This invention relates to electronic test sockets, and more particularly to sockets for testing memory modules.

Some of the most widely used electronic components are small printed-circuit board (PCB) daughter cards known as memory modules. Personal computers (PC's) and other electronic systems use memory modules. Memory modules are plugged into sockets on a motherboard, reducing a need to directly mount individual memory chips on the motherboard. The memory modules are built to meet specifications set by industry standards, thus ensuring a wide potential market and low cost. Single-inline-memory modules (SIMM) and dual-inline-memory modules (DIMM) are two types of memory modules.

Memory modules can be tested using general-purpose electronic-component testers, but these testers tend to be quite expensive. Memory modules can also be tested in PC-based testers. Since PC's are very inexpensive, test costs can be significantly reduced. The memory modules being tested can be inserted into memory module sockets on a PC motherboard, which executes a memory test program to test the memory modules. See as examples U.S. Pat. Nos. 6,178,526, 6,415,397, 6357023, and 6,351,827.

A drawback to using a PC motherboard for testing memory modules is that the memory module sockets can become worn with use, since thousands of different memory modules may be inserted and removed for testing. The standard memory module sockets on a PC motherboard are not designed for such frequent replacement of the memory modules. Specialized test sockets such as Yamaichi and zero-insertion-force (ZIF) sockets may replace the standard memory module sockets on PC motherboards used as testers.

A variety of ZIF sockets are known. Some ZIF sockets have a fixed housing that surrounds a membrane that has metal contact pads printed on it. The membrane is flexible, allowing it to move slightly as the memory module is inserted into the test socket. The flexible nature of the membrane reduces the force needed to insert the memory module into the test socket, compared with the force needed to insert the memory module into a rigid test socket that has metal contacts attached directly to the rigid housing. An elastic material known as an elastomer may be placed between the membrane and the housing to accommodate differences in module thickness.

While such test sockets are useful, an improved ZIF test socket is desired. Some pressure from the membrane is needed to make good electrical contact once the memory module is inserted into the test socket. The membrane may still exert some force on the memory module during insertion and removal, which may cause damage such as scratching the contact pads of the memory module as the module's contacts slide along the membrane.

The test socket itself may also become damaged during insertion of the memory module. The sharp edges of the module's PCB may scratch the membrane or the metal contacts on the membrane as the memory module is slid into the test socket.

Accurate placement or alignment of the memory module into the test socket may be needed. A test socket with an alignment guide is desired to ease alignment requirements and facilitate testing. A test socket with reduced insertion force is desirable.

DETAILED DESCRIPTION

The present invention relates to an improvement in test sockets. The following description is presented to enable one of ordinary skill in the art to make and use the invention as provided in the context of a particular application and its requirements. Various modifications to the preferred embodiment will be apparent to those with skill in the art, and the general principles defined herein may be applied to other embodiments. Therefore, the present invention is not intended to be limited to the particular embodiments shown and described, but is to be accorded the widest scope consistent with the principles and novel features herein disclosed.

The inventors have realized that a test socket with a flexible membrane is desirable for making good electrical contact during testing. Rather than use a fixed, rigid housing, the inventors use a moveable housing that opens to allow easy insertion and removal of the memory module. The housing moves to clamp shut for testing. Since the housing opens for insertion and removal, the forces needed for insertion and removal of the memory module can be greatly reduced.

The membrane is attached to the movable housing. Thus when the housing opens, the membrane is pulled away from the memory module. The memory module can then be freely removed with little or no sliding along the membrane, minimizing damage or scratching.

A guide can be provided to guide the memory module into the desired position inside the test socket. The guide can be fixed while the housing and the attached membrane move to clamp against the inserted memory module after proper alignment by the guide.

Figure 1:
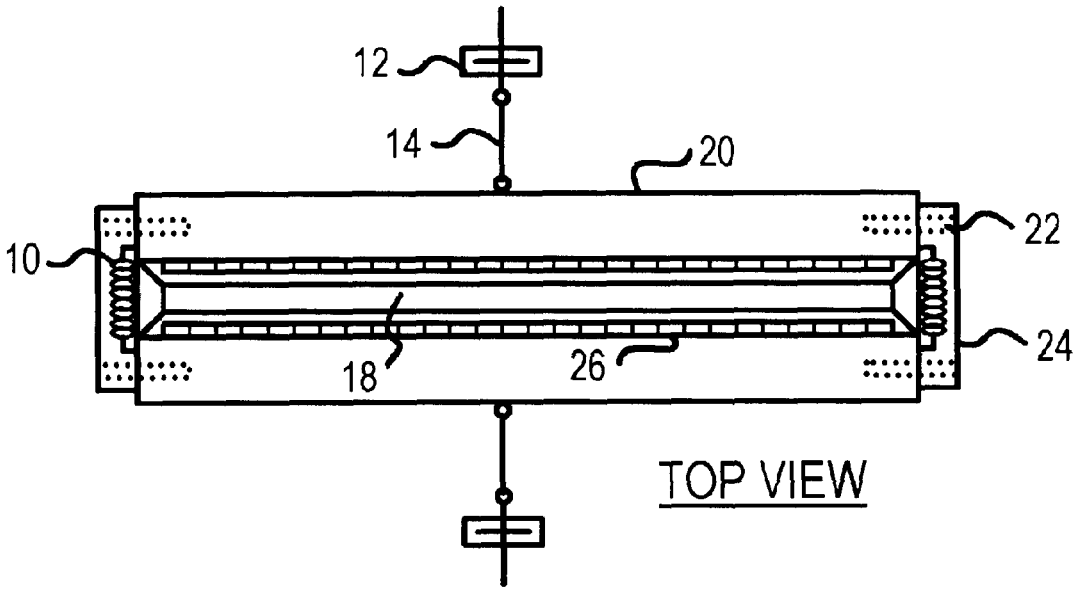
FIGS. 1–4 show different views of a clam-shell housing test socket with mechanical linkages for opening and closing the housing.
Figure 2:
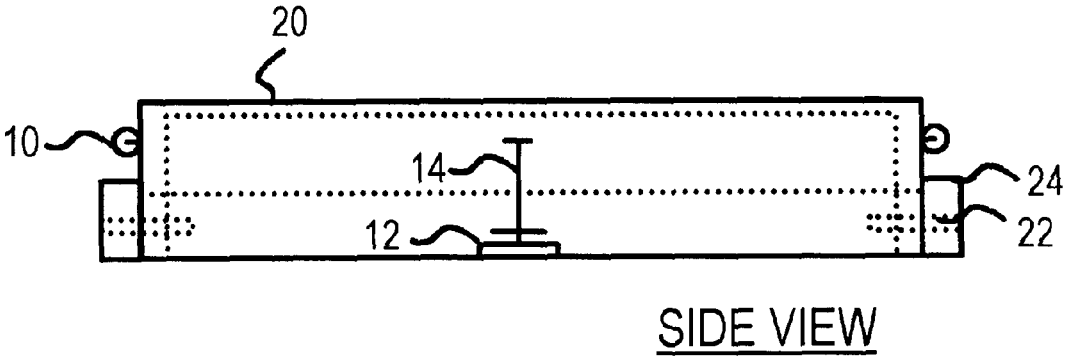
Figure 3:
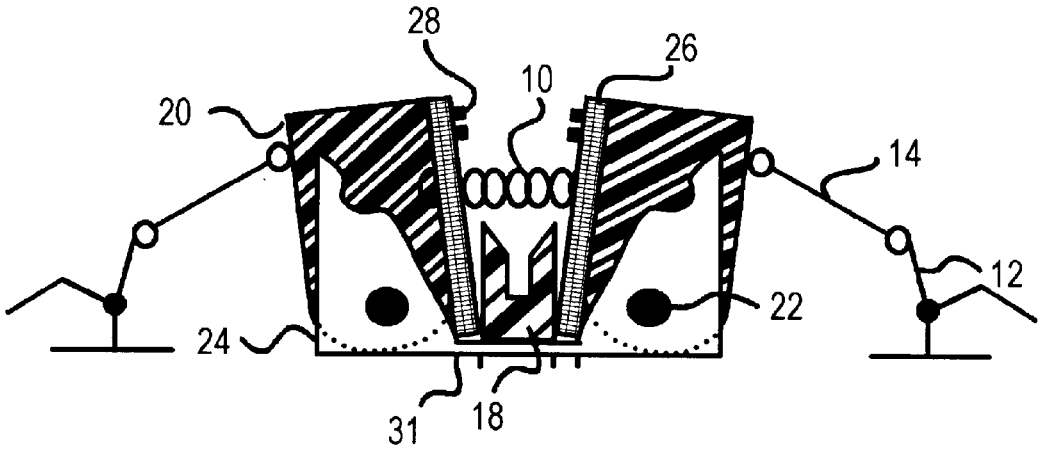
Figure 4:
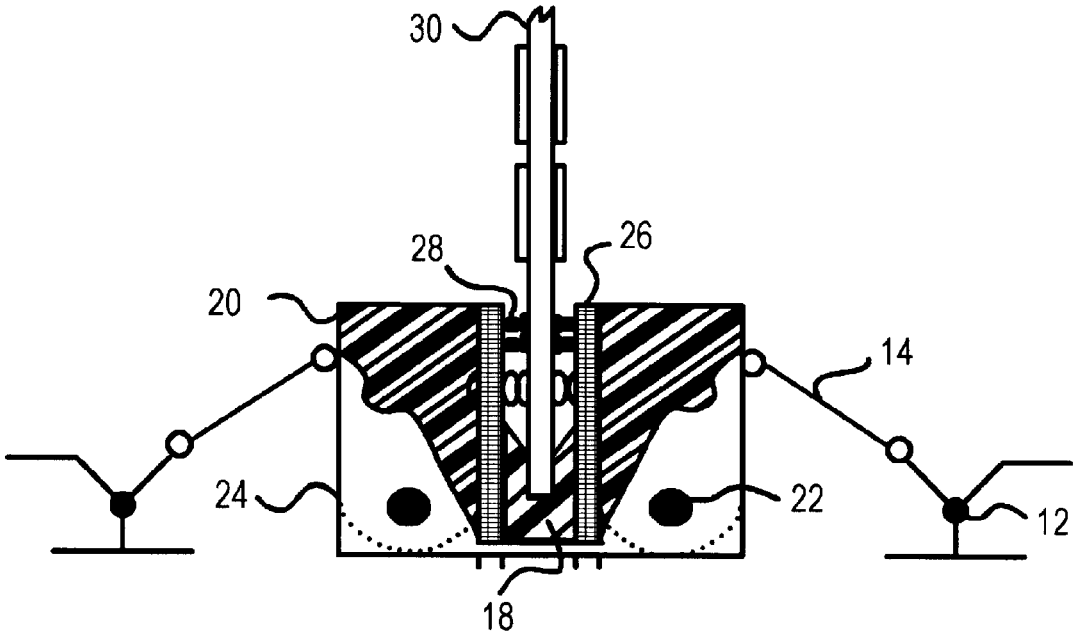

FIGS. 1–4 show different views of a clam-shell housing test socket with mechanical linkages for opening and closing the housing. FIG. 1 is a top view of the opened test socket with mechanical linkages. The memory module under test is dropped into guide 18, which has a beveled opening to funnel the edge of the memory module into the proper position. Metal contacts formed on membranes 26 face inward and make contact with metal contact pads on the memory module under test when the test socket is closed, such as shown in FIG. 4.

The two halves of housing 20 support membranes 26 on either side of the socket opening. Each half of housing 20 pivots on hinge 22, which can be a pair of short hinges attached to each end of base 24 as shown, or can be one long hinge (not shown).

The two halves of housing 20 are forced apart from one another to open the test socket by one or more springs 10.

Each half of housing 20 is connected by linkages 14 to switch 12, which can be moved by a person or automated machine to open and close the test socket. Many different arrangements, angles, and positions can be devised for linkages 14 and switch 12 to open and close housing 20.

FIG. 2 is a side view of the test socket with the mechanical linkages. Base 24 connects to housing 20 by hinges 22, which allow housing 20 to pivot around hinges 22 to open and close the test socket opening. Switch 12 is moved to pull on linkages 14 to open housing 20 (toward the viewer in this side view) or to push on linkages 14 to close housing 20 (away from the viewer in this side view). Springs 10 force the test socket into the open position when no force is applied to switch 12, although switch 12 could be held in place for both open and closed positions to eliminate the need for springs 10.

FIG. 3 is a cross-sectional end view of the test socket held in the open position with the mechanical linkages. The memory module can be inserted or removed when the test socket is open. Spring 10 forces the two halves of housing 20 apart to keep the test socket in the open position. Linkages 14 and switch 12 are pushed outward as housing 20 pivots around hinges 22. Base 24 holds hinges 22 but is not otherwise attached to housing 20. Guide 18 is attached to base 24 and does not move when housing 20 is opened and closed.

Membranes 26 are attached to housing 20 and have socket contacts 28 formed thereon. Membranes 26 can have other contacts or pads formed near the bottom of the test socket for attachment to a pin connector plug or socket, a PCB of a tester, a PC motherboard PCB, or another part of the tester. For example, membranes 26 could be surface mounted to an adapter board that is plugged into a memory module socket on a PC motherboard tester, or to an adapter board for an automated tester. Pins 31 can be attached to membranes 26 or formed on membranes 26 to make contact from the test socket to a tester board or motherboard tester.

Since housing 20 is open, membranes 26 are pulled away from the opening. This allows memory module 30 to be inserted into the opening of the test socket or removed without force between socket contacts 28 on membranes 26 and the contact pads of memory module 30. Thus the pads are not scratched during insertion and removal. Guide 18 allows memory module 30 to be guided into position without the edges of memory module 30 poking at membranes 26, since membranes 26 are pulled out of the way by the opening of housing 20.

FIG. 4 is a cross-sectional end view of the test socket held in the closed position with the mechanical linkages. Memory module 30 can be tested when the test socket is closed, when both halves of housing 20 are clamped together over memory module 30.

Switch 12 has been activated, pushing linkages 14 inward, causing the two halves of housing 20 to pivot around hinges 22 and close the opening of the test socket. Spring 10 is compressed, since the force of switch 12 and linkages 14 overcomes the force of spring 10.

Closing housing 20 pushes membranes 26 toward and around memory module 30, causing socket contacts 28 on membranes 26 to clamp onto the contact pads on memory module 30. A sufficient clamping force is applied by the closing of housing 20 to make a good electric contact. A springy or elastic elastomer layer can be placed between membranes 26 and housing 20 to allow for some variation in thickness of memory module 30, and to improve the evenness of the contact force.

Figure 5:
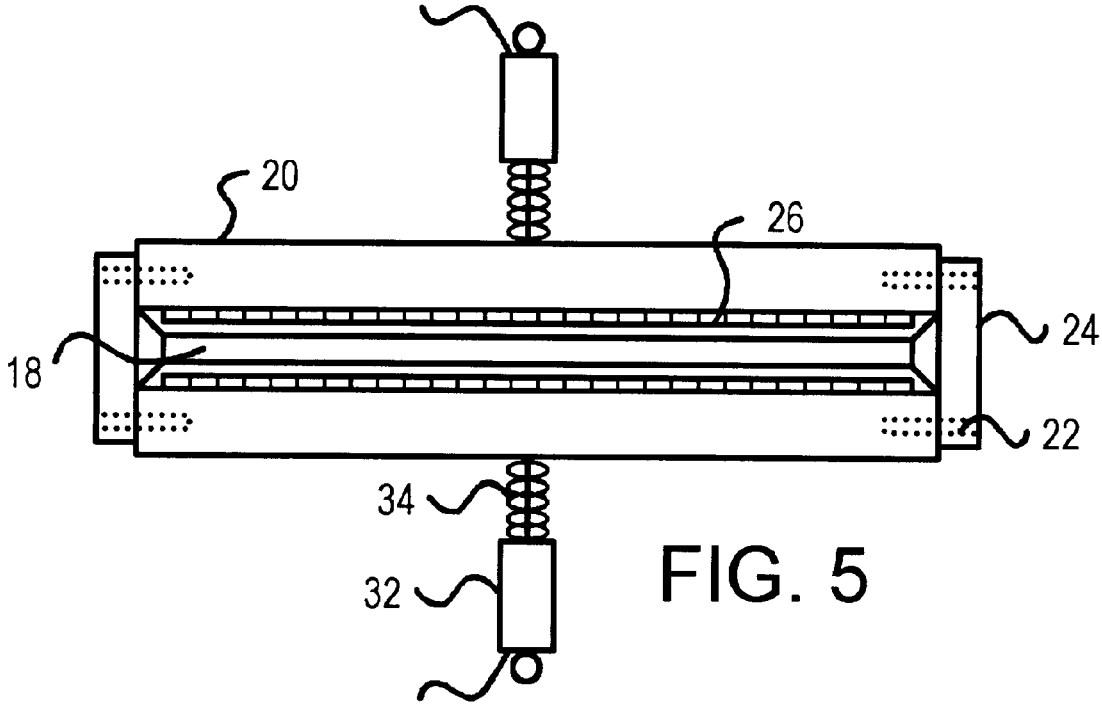
FIGS. 5–7 show a test socket using a solenoid or air cylinder to open and close the housing.
Figure 6:
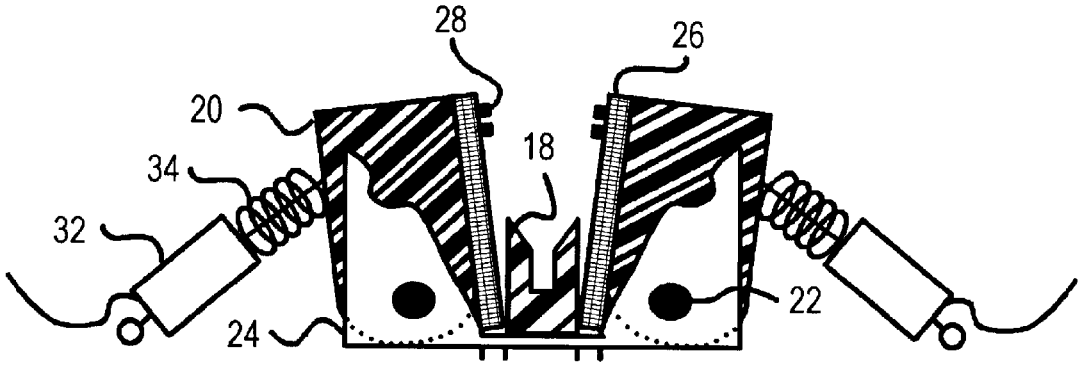
Figure 7:
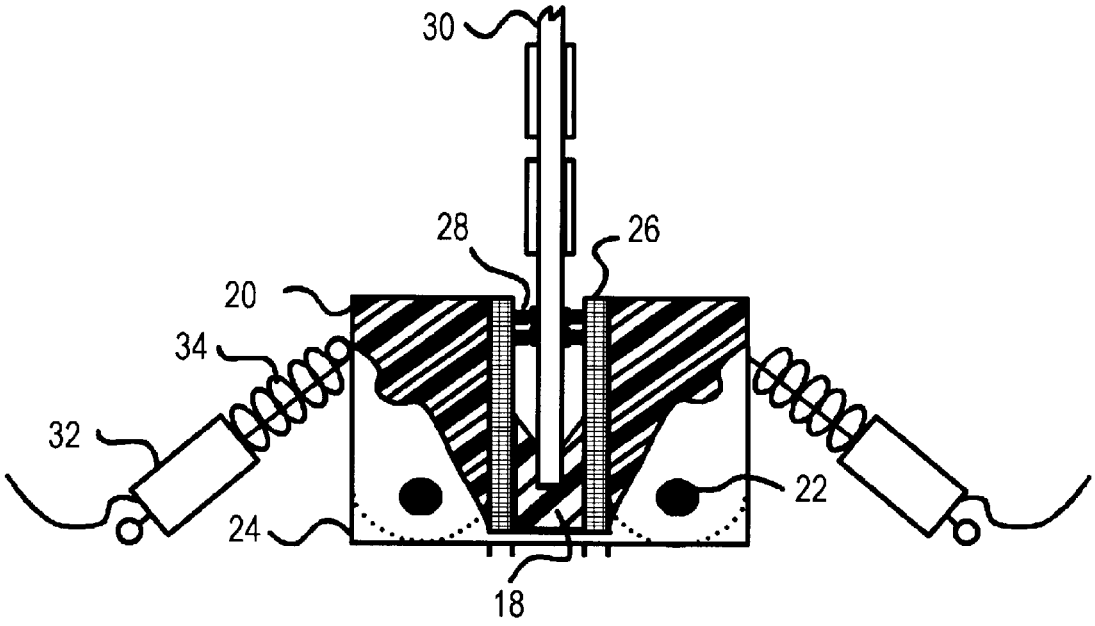

FIGS. 5–7 show a test socket using a solenoid or air cylinder to open and close the housing. Springs 34 forces housing 20 to clamp shut around an inserted memory module in the unactivated state. To open housing 20, solenoids 32 are activated by electric current to pull a rod connected to housing 20, compressing springs 34. Cylinders that are selectively filled with pressurized air or other activating devices could replace solenoids 32.

When the test socket is open, as shown in FIGS. 5, 6, the memory module can be inserted and guided to the proper position by guide 18, which has a bevel or funnel shape. When solenoids 32 are turned off, (FIG. 7) springs 34 push on housing 20, causing membranes 26 to push toward each other, allowing socket contacts 28 to make contact with metal contacts of the inserted memory module (FIG. 7).

Solenoids 32 can be angled or can be perpendicular to the plane of the memory module. Other arrangements are possible.

Figure 8:
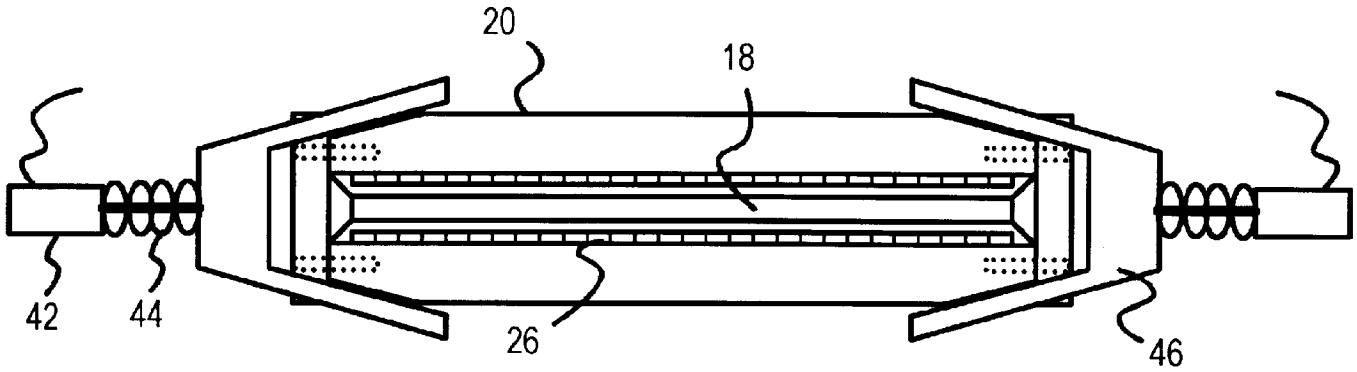
FIG. 8 shows a clamping test socket with end solenoids activators in a closed position.

FIG. 8 shows a clamping test socket with end solenoids activators in a closed position. Rather than attach solenoids 32 to the longer sides of housing 20, solenoids 32 can be located near to the narrow ends. This allows for a higher density packing of test sockets on a board, since solenoids are located within the narrow pitch of the test sockets.

Scooped vise clamps 46 are moved together by springs 44, and are moved apart from each other by activation of solenoids 42. Scooped vise clamps 46 have an angled interior that fits over the ends of both halves of housing 20. The sides of housing 20 can also be angled to be parallel to the angled interior edges of scooped vise clamps 46. When solenoids 42 are released, scooped vise clamps 46 are pressed by springs 44 into the halves of housing 20, pinching together the halves of housing 20. This pinching action caused by the angled interior edges of scooped vise clamps 46 causes housing 20 to clamp together in the closed position.

Figure 9:
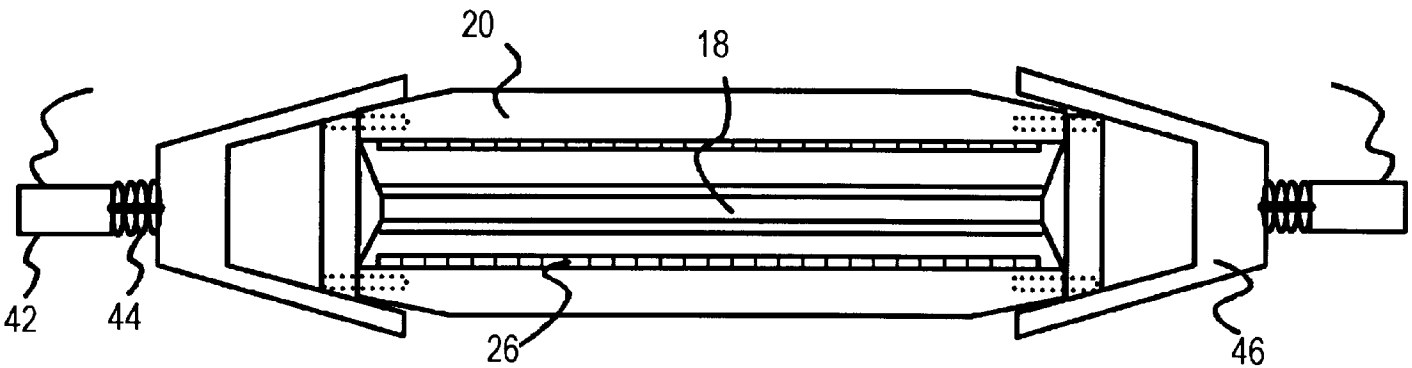
FIG. 9 shows a clamping test socket with end solenoids activators in an open position.

FIG. 9 shows a clamping test socket with end solenoids activators in an open position. When solenoids 42 are activated, the force of springs 44 is overcome, causing scooped vise clamps 46 to be pulled apart. The two halves of housing 20 can be pushed apart by a spring between the two halves (not shown), such as spring 10 in FIGS. 1–4.

Figure 10:
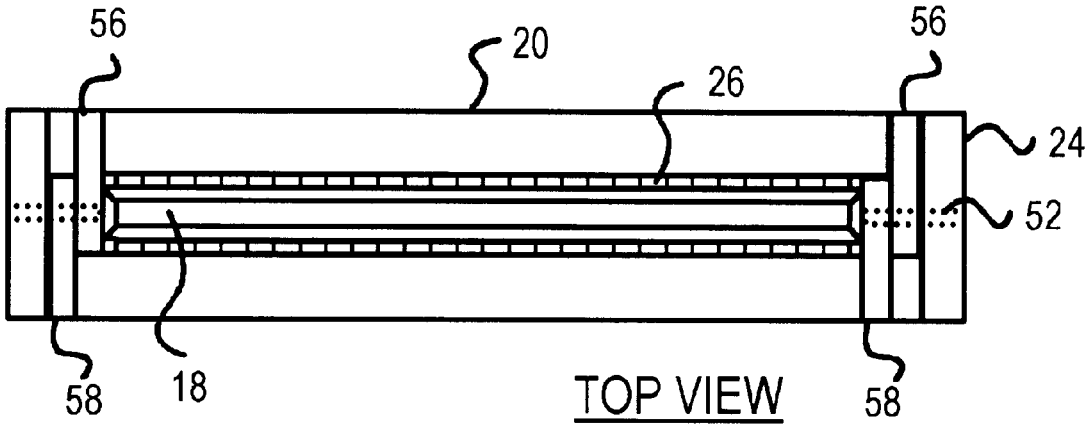
FIGS. 10–11 show an alternate embodiment having a single shared hinge.
Figure 11:
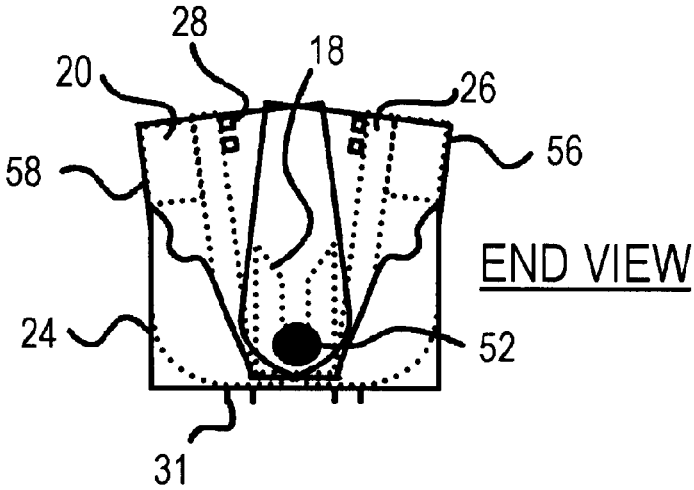

FIGS. 10–11 show an alternate embodiment having a single shared hinge. Rather than have separate hinges for each of the two halves of housing 20, shared hinge 52 connects to both halves of housing 20 and to base 24. Housing 20 can be taller or have a lower extension to reach shared hinge 52. Shared hinge 52 could be one long hinge or could be two or more co-linear hinges at opposite ends of the test socket. End caps 56, 58 for each housing 20 can overlap, with shared hinge 52 passing through base 24, end cap 56 for the upper housing 20, and end cap 58 for the lower housing 20 of FIG. 10.

Alternate Embodiments

Several other embodiments are contemplated by the inventors. For example only one spring may be used, or multiple springs may be used, or no springs used. Springs may be traditional metal coil springs, or plastic clips, or a flexing portion of housing 20 or base 24 that exerts a force when compressed. Additional springs, solenoids, switches, or linkages could be used. The test socket may be bolted directly to the motherboard or other test board, or may be on a separate board or panel. Scooped vise clamps could be on both ends of the test socket, or just one scooped vise clamp could be used on just one of the ends.

The membranes can have metal wiring traces printed on them, and could have vias and multiple layers. Other components such as bypass capacitors, resistors, or even logic or clock chips could be mounted on the membranes.

Base 24 and guide 18 could be integrated together or could be separate. Guide 18 could be split into several pieces, as could base 24 and housing 20. An additional fixed housing or cover could surround housing 20 and the entire test socket. Parts such as the housing, base, and guide could be made from plastic or metal or some other material. Air cylinders, switches, springs, and solenoids could operate in an inverse fashion, activated to close rather than to open, and various linkages, gears, levers, etc. could be added. Many different shapes may be used for various components. The membranes may be attached to the housing by bolts, screws, glue, or even using another housing or component. Rather than use discrete hinges, the hinges may be an extension of the housing or base.

Any advantages and benefits described may not apply to all embodiments of the invention. When the word "means" is recited in a claim element, Applicant intends for the claim element to fall under 35 USC Sect. 112, paragraph 6. Often a label of one or more words precedes the word "means". The word or words preceding the word "means" is a label intended to ease referencing of claims elements and is not intended to convey a structural limitation. Such means-plus-function claims are intended to cover not only the structures described herein for performing the function and their structural equivalents, but also equivalent structures. For example, although a nail and a screw have different structures, they are equivalent structures since they both perform the function of fastening. Claims that do not use the word "means" are not intended to fall under 35 USC Sect. 112, paragraph 6. Signals are typically electronic signals, but may be optical signals such as can be carried over a fiber optic line.

The foregoing description of the embodiments of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. A test socket comprising:

a base for attachment to a test board;

a guide having a bevel for accepting an edge of a memory module during insertion into the test socket, the bevel for sliding the memory module into a position for testing;

a first housing shell, pivotally attached to the base along a first pivot axis;

a first activator, coupled to the first housing shell, to move the first housing shell to pivot around the first pivot axis to open and close the test socket;

a first membrane, attached to the first housing shell to pivot with the first housing shell;

first contacts on the first membrane, that make physical and electrical contact with first metal contact pads on a first surface of the memory module when the first activator pivots the first housing shell to close the test socket, but do not make electrical or physical contact with the first metal contact pads on the memory module when the first activator pivots the first housing shell to open the test socket;

a second housing shell, pivotally attached to the base along a second pivot axis;

a second activator, coupled to the second housing shell, to move the second housing shell to pivot around the second pivot axis to open and close the test socket;

a second membrane, attached to the second housing shell to pivot with the second housing shell; and second contacts on the second membrane, that make physical and electrical contact with second metal contact pads on a second surface of the memory module opposite the first surface when the second activator pivots the second housing shell to close the test socket, but do not make electrical or physical contact with the second metal contact pads on the memory module when the second activator pivots the second housing shell to open the test socket.

2. The test socket of claim 1 wherein the first housing shell pivots toward the second housing shell to close the test socket, but pivots away from the second housing shell to open the test socket;

wherein the second housing shell pivots toward the first housing shell to close the test socket, but pivots away from the first housing shell to open the test socket.

3. The test socket of claim 2 wherein an opening above the guide is enlarged by the first and second housing shells pivoting away from each other to open the test socket, but the opening above the guide is reduced by the first and second housing shells pivoting toward each other to close the test socket.

4. The test socket of claim 3 wherein the first housing shell is pivotally attached to the base by a first hinge along the first pivot axis;

wherein the second housing shell is pivotally attached to the base by a second hinge along the second pivot axis.

5. The test socket of claim 3 wherein the first housing shell is pivotally attached to the base by a first front-end hinge and a first back-end hinge both along the first pivot axis;

wherein the second housing shell is pivotally attached to the base by a second front-end hinge and a second back-end hinge both along the second pivot axis, whereby four hinges attach housing shells to the base.

6. The test socket of claim 3 wherein the first pivot axis and the second pivot axis are a same axis.

7. The test socket of claim 3 wherein the first activator is a solenoid, an air cylinder, or a linked mechanical switch;

wherein the second activator is a solenoid, an air cylinder, or a linked mechanical switch.

8. The test socket of claim 7 further comprising:

a spring attached between the first housing shell and the second housing shell, to exert a force between the first housing shell and the second housing shell to open or close the test socket when the first activator and the second activator are not activated.

9. The test socket of claim 3 wherein the bevel in the guide has a funnel shape.

10. A clamping test socket comprising:

a first housing half that pivots along a first pivot axis;

a first membrane having printed wiring traces and first contact pads formed thereon, the first membrane attached to the first housing half so that the first membrane moves when the first housing half pivots;

a second housing half that pivots along a second pivot axis;

a second membrane having printed wiring traces and second contact pads formed thereon, the second membrane attached to the second housing half so that the second membrane moves when the second housing half pivots;

an elongated opening formed between the first housing half and the second housing half and formed above and between the first pivot axis and the second pivot axis, the elongated opening for receiving a contactor edge of a memory module that has metal contact pads on a first surface and on a second surface opposite the first surface of the memory module;

a base guide, situated below the elongated opening, for sliding along the contactor edge of the memory module when the memory module is inserted into the elongated opening;

a scooped vise clamp positioned along a first short end of the first housing half and the second housing half; and an activator, attached to the scooped vise clamp, to move the scooped vise clamp toward the first housing half and the second housing half to close the elongated opening, the scooped vise clamp pinching together the first housing half and the second housing half;

wherein the first contact pads of the first membrane touch the metal contact pads on the first surface of the memory module when the activator closes the elongated opening by pivoting the first housing half;

wherein the second contact pads of the second membrane touch the metal contact pads on the second surface of the memory module when the activator closes the elongated opening by pivoting the second housing half, whereby the elongated opening of the clamping test socket is closed by the activator and the scooped vise clamp pinching together the first housing half which pivots about the first pivot axis and the second housing half which pivots about the second pivot axis.

11. The clamping test socket of claim 10 wherein the first pivot axis and the second pivot axis are co-linear;

further comprising:

a combination hinge along the first pivot axis that pivotally connects the first housing half to the base guide and pivotally connects the second housing half to the base guide.

12. The clamping test socket of claim 10 further comprising:

a first hinge along the first pivot axis that pivotally connects the first housing half to the base guide;

a second hinge along the second pivot axis that pivotally connects the second housing half to the base guide.

13. The clamping test socket of claim 10 wherein the activator is a solenoid, an air cylinder, or a linked mechanical switch.

14. The clamping test socket of claim 10 further comprising:

a first elastomer disposed between the first membrane and the first housing half;

a second elastomer disposed between the second membrane and the second housing half.

15. The clamping test socket of claim 10 further comprising:

a second scooped vise clamp positioned along a second short end opposite the first short end of the first housing half and the second housing half; and a second activator, attached to the second scooped vise clamp, to move the second scooped vise clamp toward the first housing half and the second housing half to close the elongated opening, the second scooped vise clamp pinching together the first housing half and the second housing half, whereby the first housing half and the second housing half are pinched together from both ends.

16. The clamping test socket of claim 10 further comprising:

a biasing spring, attached between the first housing half and the second housing half, to force the first housing half to pivot away from the second housing half to open the elongated opening when the activator is not activated.

17. The clamping test socket of claim 10 wherein the base guide has a funnel shape with a larger opening toward the elongated opening that narrows farther from the elongated opening.

18. A zero-insertion-force (ZIF) hinged clam-shell socket for testing an inserted memory module comprising:

base means for attachment to a test surface;

guide means, having a bevel for accepting an edge of a memory module during insertion, for sliding the memory module into a position for testing;

a first housing, pivotally attached to the base means along a first pivot axis;

first activator means, coupled to the first housing shell, for moving the first housing to pivot around the first pivot axis to open and close a socket;

a first membrane, attached to the first housing and pivoting with the first housing;

first contacts means, on the first membrane, for making physical and electrical contact with first metal contact pads on a first surface of the memory module when the first activator means pivots the first housing to close the socket, but for not making electrical or physical contact with the first metal contact pads on the memory module when the first activator means pivots the first housing to open the socket;

a second housing, pivotally attached to the base means along a second pivot axis; and a second membrane, attached to the second housing and pivoting with the second housing;

wherein the first housing is pivoted toward the second housing to close the socket, but is pivoted away from the second housing to open the socket.

19. The ZIF hinged clam-shell socket of claim 18 further comprising:

hinge means, coupled to the base means, for pivotally attaching the first housing to the base means, and for pivotally attaching the second housing to the base means;

second activator means, coupled to the second housing, for moving the second housing to pivot around the second pivot axis to open and close the socket;

second contacts means, on the second membrane, for making physical and electrical contact with second metal contact pads on a second surface of the memory module opposite the first surface when the second activator means pivots the second housing to close the socket, but for not making electrical or physical contact with the second metal contact pads on the memory module when the second activator means pivots the second housing to open the socket.

20. The ZIF hinged clam-shell socket of claim 19 wherein the hinge means comprises a first hinge along the first pivot axis and a second hinge along the second pivot axis, or the hinge means comprises a combined hinge along the first pivot axis and along the second pivot axis.

* * * * *